US006457941B1

(12) United States Patent
Larzelere et al.

(10) Patent No.: US 6,457,941 B1
(45) Date of Patent: Oct. 1, 2002

(54) FAN ROTOR WITH CONSTRUCTION AND SAFETY PERFORMANCE OPTIMIZATION

(75) Inventors: John C. Larzelere, Fredericksburg; Dale W. Sisson, Jr., King George; Craig S. LaMoy, King George; Charles K. Atwell, King George; Thomas W. Van Doren, Fredericksburg; Marh A. Huebner, Fredericksburg; Nicholas L. Tzortzinis, Fredericksburg, all of VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 4 days.

(21) Appl. No.: 09/804,642

(22) Filed: Mar. 13, 2001

(51) Int. Cl.[7] ..... F04D 29/00
(52) U.S. Cl. ..... 416/144; 416/203; 416/500
(58) Field of Search ..... 416/203, 144, 416/500, 213 R, 234, 197

(56) References Cited

U.S. PATENT DOCUMENTS

| | | | | | |
|---|---|---|---|---|---|
| 1,893,184 | A | * | 1/1933 | Smellie | |
| 3,006,603 | A | * | 10/1961 | Caruso et al. | 253/39 |
| 3,995,970 | A | | 12/1976 | Nobuyuki | 415/119 |
| 4,131,387 | A | | 12/1978 | Kazin et al. | 415/119 |
| 4,253,800 | A | * | 3/1981 | Segawa | 416/203 |
| 4,431,376 | A | | 2/1984 | Lubenstein et al. | 416/223 A |
| 4,930,984 | A | * | 6/1990 | Kesel et al. | 416/203 |
| 5,000,660 | A | * | 3/1991 | Van Houten et al. | 416/203 |
| 5,169,288 | A | | 12/1992 | Gliebe et al. | 415/119 |
| 5,184,938 | A | | 2/1993 | Harmsen | 416/223 R |
| 5,478,199 | A | | 12/1995 | Gliebe | 415/119 |
| 5,681,145 | A | | 10/1997 | Neeley et al. | 416/203 |
| 6,149,381 | A | * | 11/2000 | Lee | 415/53.1 |
| 6,345,951 | B1 | * | 2/2002 | Choi | 415/1 |
| 6,379,111 | B1 | * | 4/2002 | Katoh et al. | 415/119 |

* cited by examiner

*Primary Examiner*—Edward K. Look
*Assistant Examiner*—James M McAleenan
(74) *Attorney, Agent, or Firm*—James B. Bechtel, Esq.; Peter J. Van Bergen, Esq.

(57) ABSTRACT

A one-piece fan rotor optimized for construction and safety performance criteria is provided. The rotor has a hub with a radial cross-section defined by an I-beam. A plurality of unequally-spaced rotor blades are disposed circumferentially around and extend radially outward from the hub. Each rotor blade has a root portion coupled to the hub with the root portion defined by a concave fillet circumventing the rotor blade. For rotational balance, at least one of the forward side and backside of the hub incorporates an axially extending pad. Methods are provided for controlling stress on the rotor and for balancing the rotor.

18 Claims, 6 Drawing Sheets

FAN ROTOR WITH CONSTRUCTION AND SAFETY PERFORMANCE OPTIMIZATION

CROSS-REFERENCE TO RELATED PATENT APPLICATIONS

This patent application is co-pending with or related patent Application entitled "QUIET AND EFFICIENT HIGH-PRESSURE FAN ASSEMBLY" (Navy Case No. 82260), filed on the same date and owned by the same assignee as this patent application.

FIELD OF THE INVENTION

The invention relates generally to fan rotors, and more particularly to a fan rotor that is optimized for use in a high-pressure axial flow fan assembly.

BACKGROUND OF THE INVENTION

U.S. Navy ships incorporating the Collective Protection System (CPS) in their ventilation system design use vane-axial (in-line duct) supply fans that are required to develop pressures that are substantially greater than those developed by conventional ventilation system fans. These CPS high-pressure ventilation supply fans are designed to overcome normal system pressure losses as well as pressure losses associated with a series of specialized air filters. In addition, the typical CPS supply fan must also be capable of maintaining a pressurized zone within the ship's hull.

Current U.S. Navy CPS ventilation systems use conventional fan technology in-terms of rotor blade and stator vane configurations. That is, rotor blades are typically based on profiles of blended circular arcs that are not necessarily the most efficient from an aerodynamic perspective, and not the quietest from an aero-acoustic perspective. Aerodynamic inefficiencies and noise sources in the high-pressure fan assemblies include rotor blade vortex generation, flow separation from both rotor blades and stator vanes, and the interaction of the air as it transitions from rotor blades to stator vanes. The conventional solution for a low efficiency fan design involves the use of a higher horsepower fan motor to perform the aerodynamic work. The conventional solution used to keep the airborne noise levels within the required U.S. Navy specification for allowable space noise levels involves the use of a greater amount of acoustic attenuation material. Neither of these conditional solutions is desirable.

The afore-referenced co-pending patent application discloses a van-axial fan assembly that is addresses the issues of aerodynamic efficiency and noise. Briefly, this application discloses a fan assembly having a hub defining an axis of rotation with a plurality of rotor blades disposed circumferentially around and extending radially outward from the hub. Each rotor blade is constructed to define a straight-ruled leading edge that extends outward from the hub. There is unequal angular spacing between leading edges of adjacent ones of the rotor blades. Each rotor blade has a trailing edge that extends from the hub at a skew angle measured in a radial plane of the hub with respect to a first line extending radially outward from the axis of rotation. Each rotor blade has an axial chord length defined across a central portion thereof parallel to the hub's axis of rotation. The plurality of rotor blades further defines a solidity of greater than 1. A plurality of stator vanes are disposed circumferentially around and extend radially from a frame. There are a lesser number of stator vanes than rotor blades. Each stator vane has a leading edge that extends from the frame at: i) an inclined angle measured in the radial plane with respect to a second line extending radially outward from the axis of rotation, and ii) a lean angle measured in an axial plane of the frame with respect to a third line extending radially outward from the axis of rotation. The frame with its stator vanes is positioned adjacent hub and rotor blades such that an axial gap is defined between the trailing edge of the rotor blades and the leading edge of the stator vanes. The axial gap increases with radial distance from the hub as defined by the skew angle and incline angle.

Issues left unresolved by this innovative fan assembly revolve around optimization of both mechanical construction techniques and safety performance criteria for the fan assembly's rotor. A goal of such optimization is to minimize changes to the rotor's aerodynamic and noise characteristics while achieving both a lightweight, cost-effective construction that performs within acceptable stress levels.

SUMMARY OF THE INVENTION

Accordingly, it is an object of the present inventions to provide a fan rotor for use in a high-pressure vane-axial fan assembly.

Another object of the present invention is to provide construction techniques for a high-pressure fan rotor that are cost-effective.

Still another object of the present invention is to provide construction techniques for producing a lightweight high-pressure fan rotor.

Yet another object of the present invention is to provide construction techniques for producing a fan rotor that achieves acceptable levels of stress performance.

A further object is to provide methods for optimizing an existing fan rotor design in terms of stress level performance while minimizing effects on the fan rotor's previously-designed aerodynamic characteristics.

Other objects and advantages of the present invention will become more obvious hereinafter in the specification and drawings.

In accordance with the present invention, a one-piece fan rotor is optimized for construction and safety performance criteria. The rotor can be sand cast to meet cost restrictions. The rotor has a hub with a radial cross-section defined by an I-beam. Specifically, the I-beam shape is defined by an inner annular flange and an outer annular flange coupled to one another by an annular disk. A plurality of unequally-spaced rotor blades are disposed circumferentially around and extend radially outward from the outer annular flange of the hub. Each rotor blade has a root portion coupled to the hub with the root portion defined by a concave fillet circumventing the rotor blade. For balancing purposes, the hub incorporates at least one axially extending pad positioned out of the air flow about the rotor. In a cast rotor assembly, the pads are cast in place. In a machined rotor assembly, the pad is formed as part of an axially extending ring with an angular portion of the ring having an increased axial length relative to a remainder of the ring. Stress on the rotor is controlled by adjusting the radius of curvature of the concave fillet at the blade's root, and by adjusting radial thickness of the hub's outer annular flange.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several view of the drawings and wherein.

DETAILED DESCRIPTION OF THE INVENTION

Figure 1:
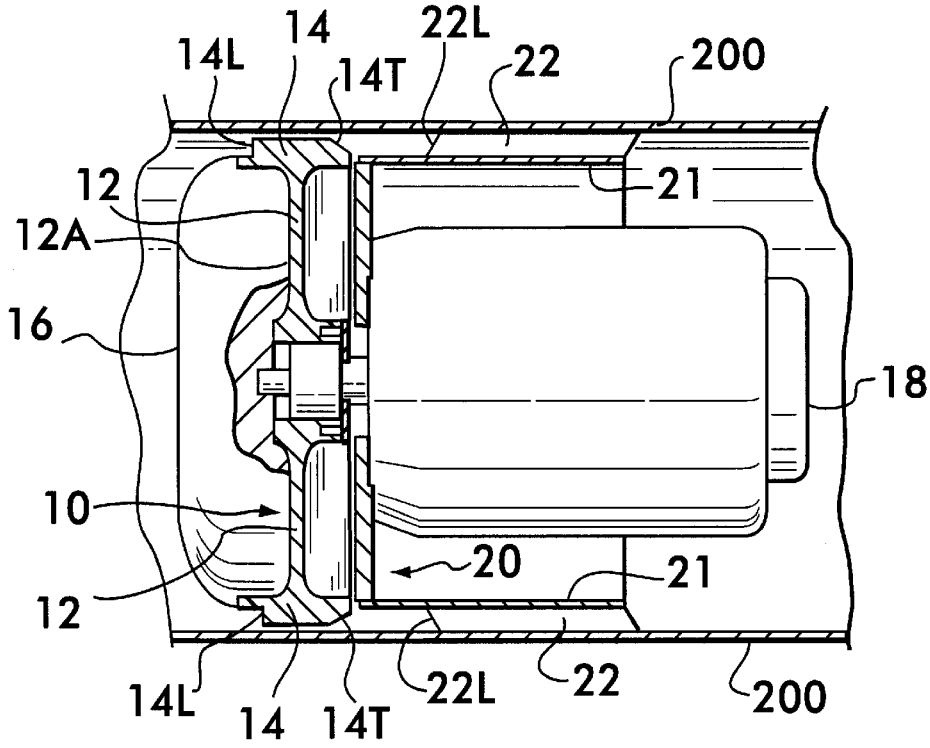
FIG. 1 is a schematic sectional view of an embodiment of a fan assembly that includes a fan rotor that can be optimized in accordance with the present invention.

Referring now to the drawings, and more particularly to FIG. 1, the basic layout of a fan assembly described in the afore-referenced co-pending patent application is shown and referenced generally by numeral 100. Fan assembly 100 is fitted within a duct 200 such that the fan assembly's rotor assembly 10 is free to rotate therein. A rotor assembly 10 has a hub 12 with a radial cross-section defined by an I-beam, and has a plurality of rotor blades 14 attached at the hub's periphery and extending radially outward therefrom. Details of rotor assembly 10 related to both construction and safety performance optimization will be discussed further below.

A spinner or nose cone 16 is attached to the forward portion of rotor assembly 10 to transition the inlet airflow into the rotor blade row. As a result, a forward side 12A of hub 12 is shielded from air flow. A motor 18 is coupled to the central portion of hub 12 and is structurally supported by a stator assembly 20 which is mounted just aft of rotor assembly 10. If necessary, motor 18 can be additionally supported by support rods (not shown) extending radially outward from the rear of motor 18 to the fan housing.

Assembly 20 has a motor/stator case 21 with a plurality of stator vanes 22 mounted thereto about the periphery of case 21. As will be explained further below, stator vane 22 are spaced axially away from rotor blades 14. A combination of structural features result in a high-pressure vane-axial fan assembly that is more efficient and quieter than conventional designs. The various structural features include the design of each rotor blade 14 to include its cross-sectional shape as well as its overall shape, the arrangement of rotor blades 14 about hub 12, the spacing relationship between rotor blades 14 and stator vanes 22, and the number of rotor blade 4 and stator vanes 22.

Figure 2:
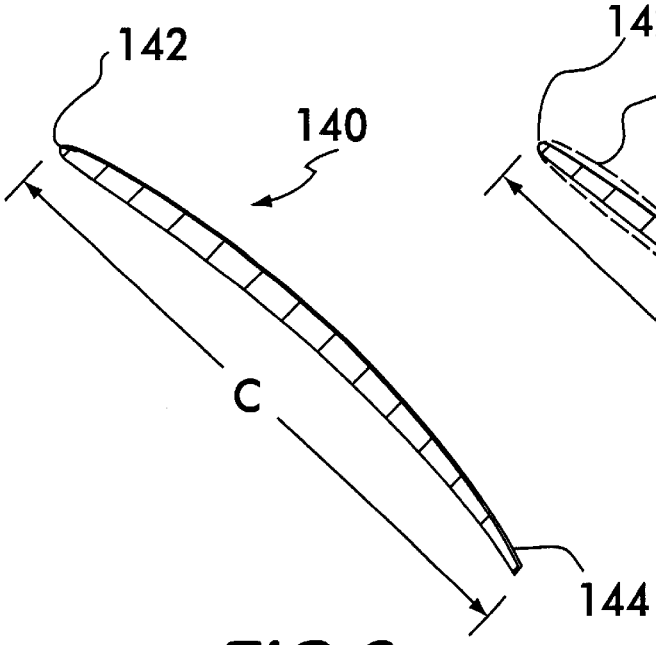
FIG. 2 is a cross-sectional view of one of rotor blades depicting its airfoil shape.

The cross-sectional shape serving as the basis; each of rotor blades 14 is an airfoil. That is, as illustrated in FIG. 2, any radial cross-section of rotor blade 14 will be an airfoil shape 140 having a leading edge 142 and a trailing edge 144 with a chord length C defined as the straight-line distance between leading edge 142 and trailing edge 144. In a preferred embodiment, airfoil shape 140 is base on the National Advisory Committee for Aeronautics (NACA) 65 series airfoil shape. The specifications for the NACA-65 series airfoil shape are described in detail in "Summary of Airfoil Data," Ira H. Abbott et al., NACA Report 824, 1945, and in "Theory of Wing Sections Including a Summary of Airfoil Data," Ira H. Abbott et al., Dover Press, New York, 1959.

Airfoil shape 140 can have its leading edge profile and/or its trailing edge profile modified. For example, if airfoil shape 140 is based on the NACA-65 series airfoil shape, one or both the leading and trailing edge profiles can be modified to define a "C4" profile where "C4" defines a thickness form used to cloth a camber line with the known C4 profile shape that is described in "Low Speed Wind Tunnel Tests on a Series of C4 Section Airfoils," N. Ruglen, Aust. Department of Supply, Aeronautic Research Labs, ARL Aero Note 275, 1966, and "Axial Flow Fans and Ducts," R. Allan Wallis, John Wiley & Sons, New York, 1983.

Figure 3:
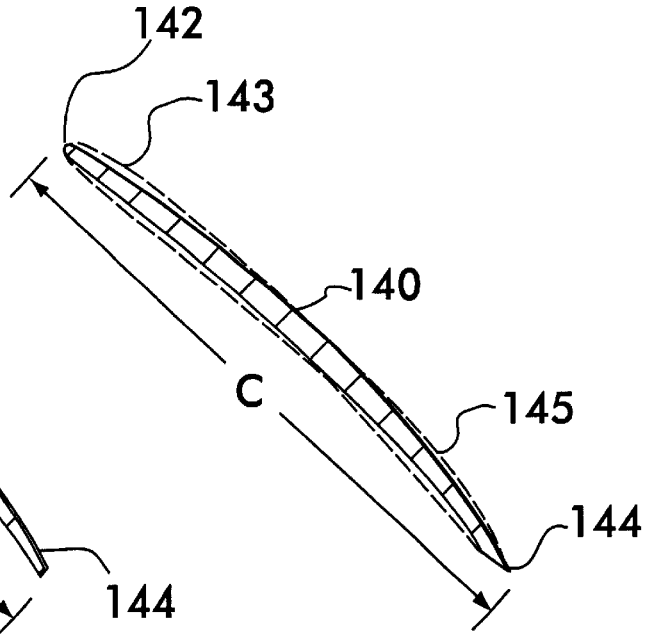
FIG. 3 is a cross-sectional view of one of the rotor blades based on the NACA-65 airfoil shape with its leading and trailing edges defined by a C4 profile.

The resulting cross-sectional shape of a rotor blade based on the NACA-65 series airfoil shape with both it's leading and trailing edge profiles modified to have C4 profile is illustrated in FIG. 3. More specifically, solid line 140 illustrates the basic NACA-65 airfoil shape dotted line 143 illustrates the C4 leading edge profile modification and dotted line 145 illustrates the C4 trailing edge profile modification.

Figure 4:
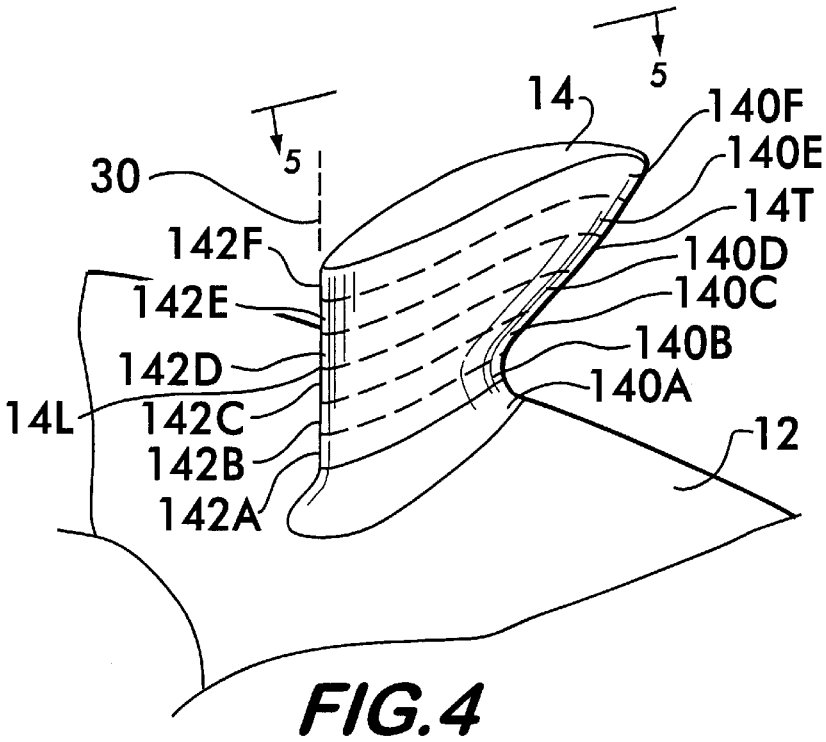
FIG. 4 is a perspective view of one rotor blade.

As just described, each rotor blade 14 has radial cross-sections defined by an airfoil shape. In other words, each rotor blade 14 can be thought of as a stack of such airfoils beginning at the blade's root and continuing radially outward along the blade's span to the blade's tip. This is best illustrated in FIG. 4 where each dotted line section 140A–140F of rotor blade 14 is an airfoil-shaped, radial cross-section of rotor blade 14. Section 140A can be considered to define the blade root, sections 140B–140E can be considered to define the blade span, and section 140F can be considered to define the blade tip.

All leading edges 142A–142F are aligned along a straight line 30 that extends outward from the periphery of hub 12. That is, all of leading edges 142A–142F are fixed a along straight line 30 so that the resulting leading edge 14L of rotor blade 14 extends along a straight ruled edge and outward from the periphery of hub 12. Straight line 30 can be, but need not be, aligned with a radial line extending out from the axis of rotation of hub 12.

Figure 5:
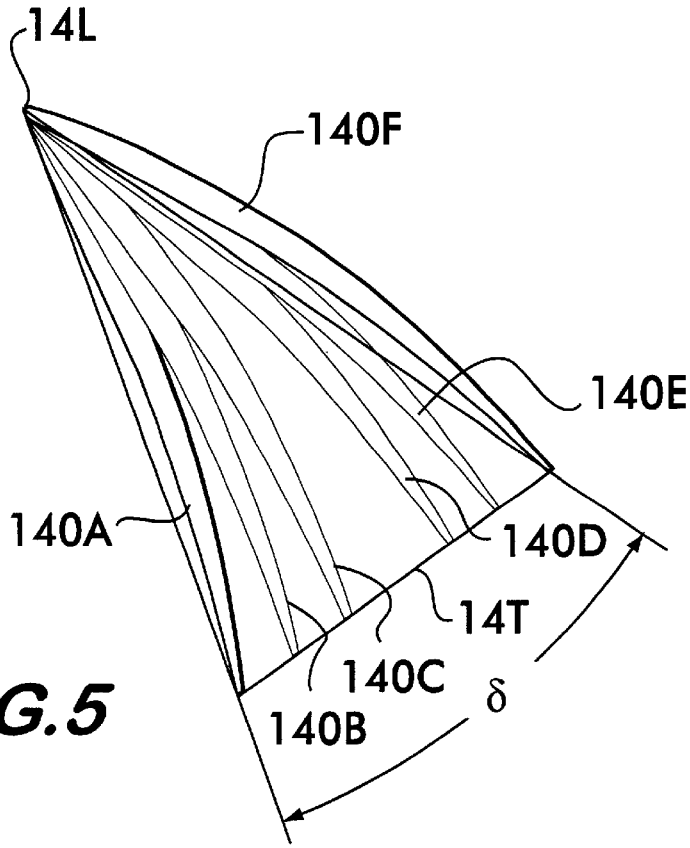
FIG. 5 is a top view of the rotor blade taken along line 5—5 of FIG. 4 and depicting the rotation of imaginary airfoil sections about the rotor blade's straight line leading edge.

Although leading edges 142A–142F are fixed along straight line 30, each adjacent radial section of rotor blade 14 is rotated slightly about straight line 30. As a result, the blade's trailing edge 14T is twisted relative to straight line 30. The collective amount of rotation from blade section 140A to blade section 140F is illustrated in FIG. 5 where the angle of rotation $\delta$ between sections 140A and 140F is exaggerated for purpose of illustration. Typically, angle of rotation δ ranges from 5–20°. Note that the division of rotor blade 14 into discrete sections 140A–140F is done for descriptive purposes only as the actual rotor blade constructed in the above fashion will define a smooth surface from blade root to blade tip.

Rotor blades 14 are irregularly spaced about hub 12 such that the angular spacing between leading edges is unequal when looking at adjacent rotor blades. In addition, when viewing rotor assembly 10 axially from either the front or back thereof, the leading edge of one rotor blade overlaps the trailing edge of the next adjacent rotor blade. This property is defined in the art as solidity where the presence of a leading edge to trailing edge overlap is defined as a solidity of greater than 1.

Figure 6:
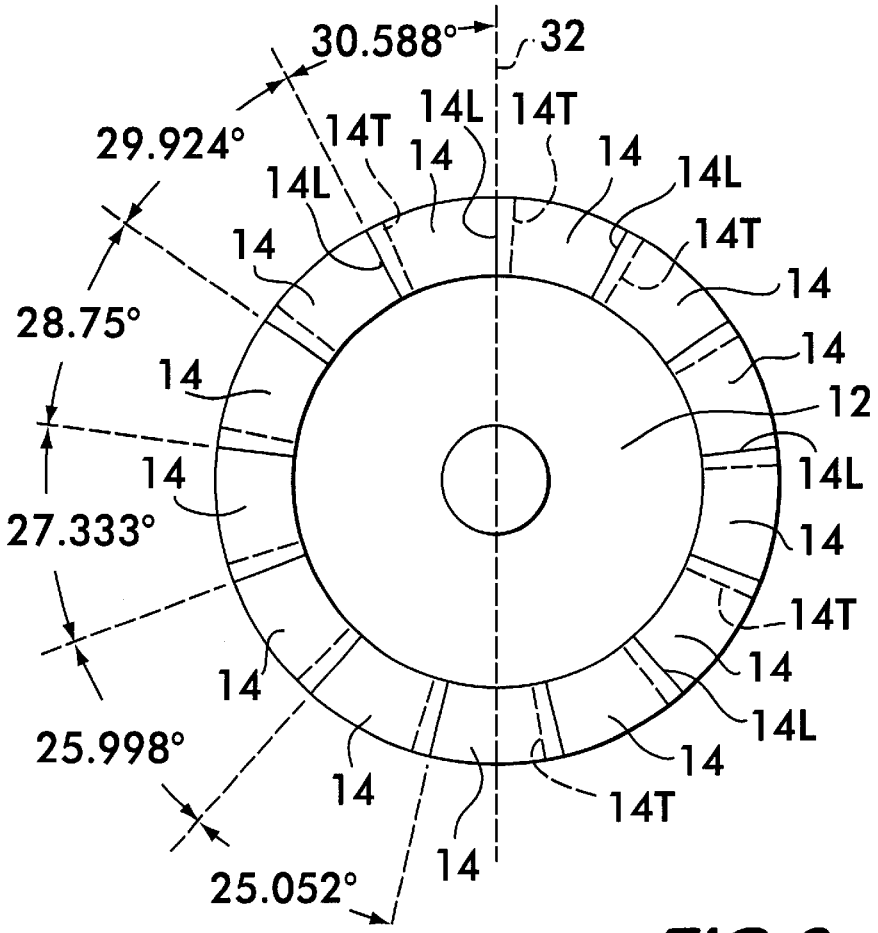
FIG. 6 is a front or axial view of one embodiment of a rotor assembly illustrating the angular spacing and overlap between adjacent rotor blades.

Referring now to FIG. 6, the irregular rotor blade spacing and solidity features are illustrated in the front or axial view of one embodiment of a rotor assembly having thirteen rotor blades 14. The leading edge of each rotor blade is indicated at 14L and the trailing edge is indicated by dashed lines at 14T. For clarity of illustration, only a few of rotor blades 14 have their leading and trailing edges so-indicated. The unequal angular spacing between the leading edges of rotor blades 14 is illustrated for one half of edge rotor assembly with the angular spacing of the other half being mirror-imaged about dashed-line 32.

Figure 7:
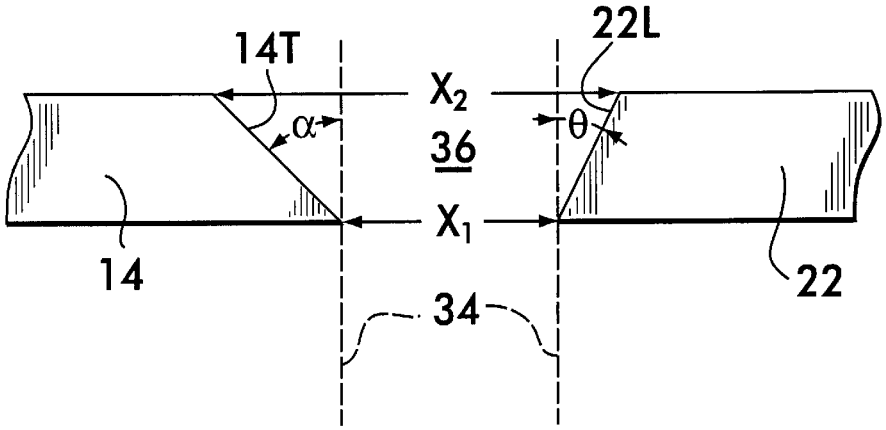
FIG. 7 is an expanded and isolated side view a rotor blade and stator vane depicting their axial spacing relationship.

The trailing edge 14T of each rotor blade 14 and the leading edge 22L of each stator vane 22 are sloped from vertical in the radial plane of the fan assembly. This is shown in the expanded and isolated side view of a rotor blade 14 and stator vane 22 illustrated in FIG. 7. Specifically trailing edge 14T of rotor blade 14 is skewed axially forward from the straight-line radial direction (indicated by dashed-line 34) by a skew angle α. The origin of radial direction 34 is the axis of rotation of the fan's rotor assembly. Leading edge 22L of stator vane 22 is slanted axially rearward from straight-line radial direction 34 by an inclined angle θ. The relationship between skew angle a and inclined angle θ is, in general, such that an axial spacing or gap 36 between trailing edge 14T and leading edge 22L increases from $X_1$ to $X_2$ with radial distance from the center of hub 12. The minimum of axial gap 36, i.e., the minimum value of $X_1$, should be equal to or greater than the axial chord length of a central portion of rotor blade 14. That is, the length defining the minimum axial gap is the chord length of rotor blade 14 at the midpoint of its blade span when measured parallel to the fan rotor assembly's rotational axis.

An included or passing angle λ is defined as the algebraic sum of skew angle a and inclined angle θ, and should be within the range of 60–75°. Typically, skew angle α is in the range of 30–50° and inclined angle θ is in the range in 20–30°.

Figure 8:
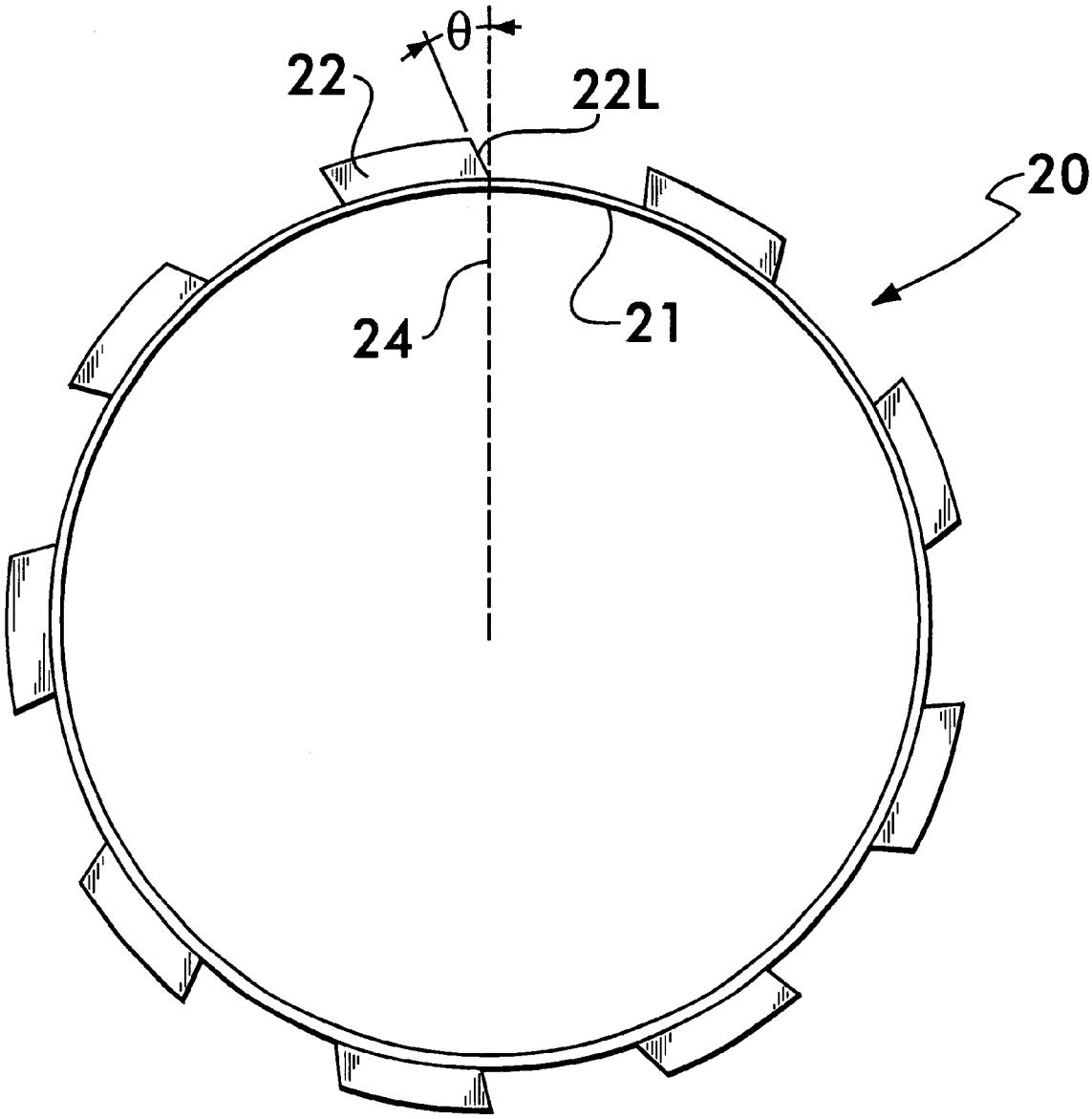
FIG. 8 is an isolated front or axial view of one embodiment of the stator assembly illustrating the lean angle that the leading edge of each stator vane makes with respect to a radius of the stator assembly.

As illustrated in the isolated front or axial view of stator assembly 20 in FIG. 8, the leading edge 22L of each stator vane 22 is also angled from hub to tip by a lean angle ϕ. Lean angle ϕ lies in an axial plane of stator assembly 20 and is measured with respect to a radius 24 of stator assembly 20. The origin of radius 24 is the axis of rotation of the fan's rotor assembly. The lean angle 9 can range between 20° and 30°.

The number of rotor blades 14 in relation to stator vanes 22 is also important. In general, it has been found that the rotor blades 14 should be less heavily aerodynamically loaded than stator vanes 22. This is accomplished by providing more rotor blades 14 than stator vanes 22 so that aerodynamic load can be spread over a greater number of rotor blade as compared to stator vanes. More specifically, it has been found that noise levels decrease when the number of rotor blades 14 is a small prime number that is approximately 1.5 times an odd number of stator vanes 22. For practical size and manufacturing considerations, the small prime number is typically between 3 and 37, i.e., one of 3, 5, 7, 11, 17, 19 23, 29, 31 and 37. In an embodiment that produced good results in terms of increased efficiency and lower noise levels, the number of rotor blades is thirteen and the number of stator vanes is nine.

The above-described fan assembly design has improved aerodynamic and noise performance. However, rotor assembly 10 must also be optimized. That is, the relationship between the rotor geometry and the fan performance has to be considered while varying the rotor geometry to achieve acceptable stresses. Changes to the geometry that have a positive effect on the stress levels within the rotor could have a negative effect on the performance of the fan. Thus, the present invention's goals with respect to fan rotor construction and safety performance optimization are to maintain the aerodynamic and noise performance levels achievable by fan assembly 100, achieve a required safety factor by assuring that operation-generated stress on the fan rotor remains within acceptable levels, and provide a design that is lightweight and cost-efficient. In order to maintain the design's aerodynamic and noise performance levels, certain structural features of rotor assembly cannot be altered. Specifically, the fixed characteristics of rotor assembly 10 are the shape and angles of its rotor blades and its overall diameter.

Figure 9:
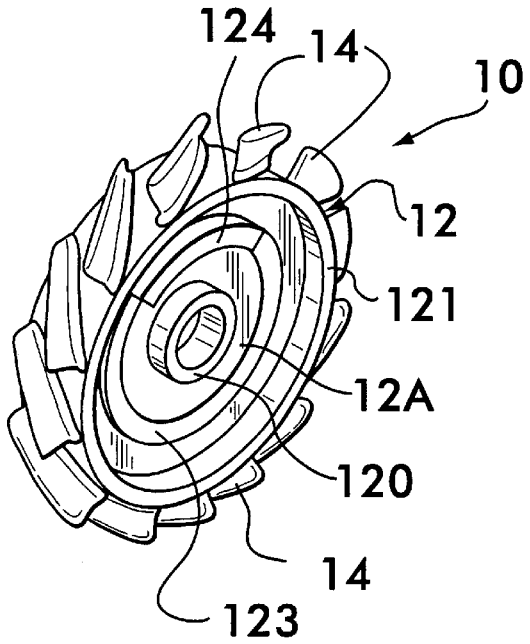
FIG. 9 is an isolated forward-side perspective view of the rotor assembly according to an embodiment of the present invention.
Figure 10:
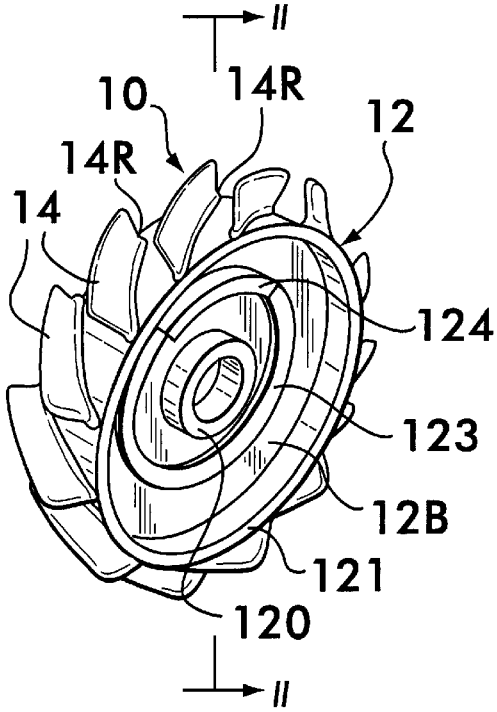
FIG. 10 is an isolated backside perspective view of the rotor assembly.
Figure 11:
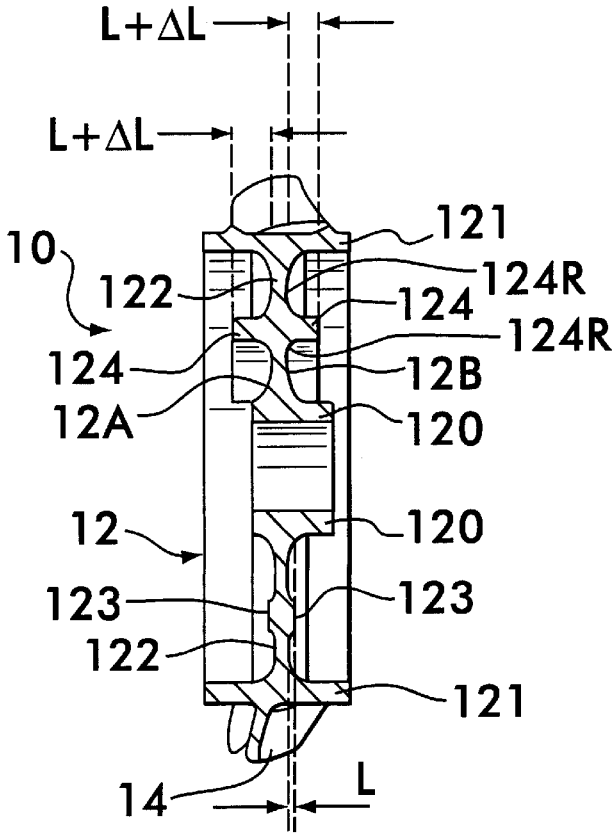
FIG. 11 is a cross-sectional view of the rotor assembly taken along line 11—11 in FIG. 10.

A rotor assembly 10 embodying construction and safety performance optimization features in accordance with the present invention will now be described with simultaneous reference to FIGS. 9, 10 and 11 where common reference numerals depict the same elements in the various views. As described above, rotor assembly 10 consists of hub 12 and rotor blades 14. As best seen in FIG. 11, hub 12 has a radial cross-section resembling that of an I-beam with an inner annular flange 120 and an outer annular flange 121 coupled to one another by an annular disk 122. A forward side 12A of 12 will, in operation, face an airflow although it can be covered by nose cone 16 as described above. A backside 12B of hub 12 will face opposite forward side 12A and, therefore, not be exposed to an airflow during rotation of rotor assembly 10 in a fan.

Other structural features of rotor assembly 10 include a root portion 14R for each rotor blade 14. Briefly, root portion 14R circumvents each rotor blade 14 at the point where rotor blade 14 joins outer annular flange 121. A discussion of root portion 14R will be provided below.

Coupled to hub 12 is a multi-plane balancing system for rotor assembly 10. In the case of a machined rotor assembly 10, forward side 12A and backside 12B of hub 12 have an annular ring 123 extending axially away from annular disk 122 by an amount L. An angular pad portion 124 of ring 123 extends a greater axial distance (L+ΔL) away from disk 122 Angular pad portions 124 are shaped as a portion of the circle formed by ring 123. Note that while single-plane balancing (i.e., the annular ring/angular pad portion are only incorporated on one side of hub 12) can be used, multi-plane balancing is preferred to prevent wobble during rotation of rotor assembly 10. In the case of a cast rotor assembly, ring 123 can be eliminated and angular pad portion(s) 124 could simply be cast in place. Further discussion of angular pad portion 124 will be provided below.

Various materials and manufacturing processes can be used to make rotor assembly 10. It is preferred that the present invention be made as an integral, one-piece assembly Accordingly, rotor assembly 10 could be made by one of machining, investment casting or sand casting processes. For greater strength yielding the best factor of safety, rotor a assembly 10 is machined from a solid billet of metal. Preferably, the metal is a high-strength aluminum alloy such as the 6061-T6 aluminum alloy. Unfortunately, the great strength associated with a machined rotor assembly comes with a high price. While investment casting is less expensive than machining, it's price is still relatively high owing to the high costs associated with making an investment cast mold. The lower-cost alternative is to sand-cast rotor assembly 10 from a sand-castable metal. Preferably, the metal is a high-strength aluminum alloy such as the A356-T6, LM-6 and LM-31 aluminum alloys. Note that the LM-31 aluminum alloy has the added advantage of not requiring heat treating after casting as is the case with other sand cast aluminum alloys. However the lower cost sand casting method/material is only viable if acceptable operational stress levels experienced by rotor assembly 10 can be maintained. Accordingly, much of the remainder of the description will focus on optimization features and techniques based on the assumption that rotor assembly 10 will be sand-cast. In this way, required safety factors are assured if a similar rotor assembly 10 is manufactured as a more expensive machined assembly made from a stronger and more expensive material.

Figure 12:
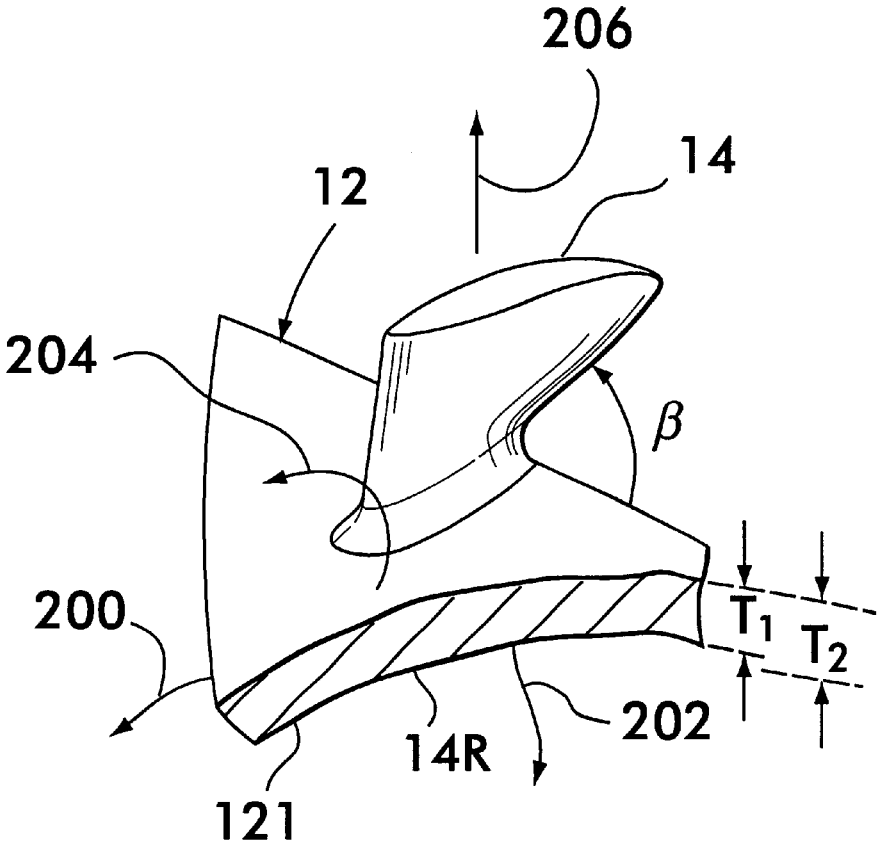
FIG. 12 is a perspective view of one rotor blade having a root portion formed in accordance with the present invention.

Analysis of rotor assembly 10 revealed that the highest stress levels occurred at the root of each rotor blade 14 where the blade joins to the hub's outer annular flange 121 This will be explained with the aid of FIG. 12 where the direction of rotation is indicated by arrow 200 and the direction of radial acceleration of rotor blade 14 is indicated by arrow 202. While undergoing rotation 200, rotor blade 14 also experiences radial acceleration 202 that causes both a bending moment 204 and tensile force 206 that must be withstood by root portion 14R. The magnitude of bending moment 204 depends on the angle β at which rotor blade 14 leans towards hub 12. Lean angle β is dependent upon the magnitude of the angle of rotation δ (described above) used to construct rotor blade 14. Note that if lean angle β is 90° (i.e., blade 14 is perpendicular to the surface of outer annular flange 121), there is no bending moment due to radial acceleration 202.

Figure 13:
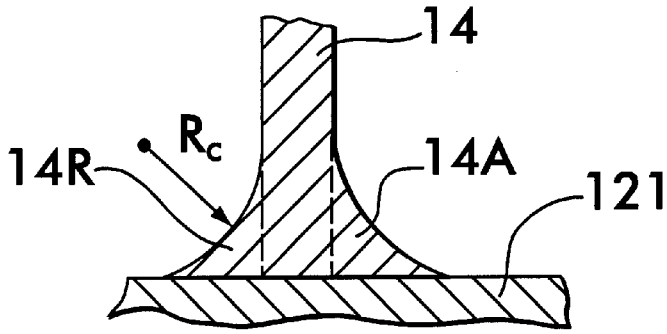
FIG. 13 is a cross-sectional view of the root portion taken along line 13—13 in FIG. 12.

To withstand stress levels at root portion 14 while minimizing effects on aerodynamic and noise performance, the present invention constructs each root blade 14 to include integral root portion 14R formed as a concave fillet that circumvents root blade 14. As shown in FIG. 13 where dashed lines represent imaginary boundaries between elements for purposes of description, the preferred shape of concave fillet root portion 14R is one with a circular radius of curvature $R_c$. Values for radius of curvature $R_c$ can be adjusted to achieve target stress levels for a particular rotor assembly. The larger the value of $R_c$, the greater the reduction of stress levels in root portion 14R. However as $R_c$ increases, the "pass through" area between rotor blades 14 decreases which could negatively affect flow characteristics Accordingly, the goal is to use the smallest $R_c$ that achieves an acceptable factor of safety. By way of example, for the various rotor assemblies used in the U.S. Navy's CPS ventilation systems, radius of curvature $R_c$ varies between approximately 0.175–0.325 inches where the value of $R_c$ increases with the length of rotor blade 14 in the radial direction.

The present invention also provides a method for selecting the radius of curvature $R_c$. In general, a mode of rotor assembly 10 is constructed and then rotated at operational speeds. As is known in the art, peak mechanical stresses on the rotor assembly can be viewed/evaluated using a variety of test/evaluation analysis tools such as a finite element analysis, which offers a high degree of resolution.

The specific method starts by constructing a model with a predicted radius of curvature. The model is rotate at speed and evaluated to see if target stress levels are maintained. If the stress levels at root portion 14R are too high, the prototype is modified by increasing radius of curvature $R_c$. Conversely, if the stress levels are very low, radius of curvature $R_c$ is decreased as the goal is to minimize $R_c$ while maintaining an acceptable stress level at root portion 14R. It was found that the relationship between stress at root portion 14R and radius of curvature $R_c$ was nearly linear thereby allowing the accurate selection of a minimal $R_c$ that achieves target stress levels after only two test runs/evaluations The present invention also provides a method to adapt to changing hub diameter. For example, if the diameter of hub 12 is to be reduced while maintaining the overall diameter of rotor assembly 10, each of rotor blades 14 increases in length radially. As mentioned above, this causes higher stresses levels at root portion 14R. However, even small reductions (e.g., 0.25 inches) in the diameter of hub 12 causes significantly increased stress levels at root portion 14R. The present invention avoids further increases in radius of curvature $R_c$ (which can negatively impact flow characteristics) by modifying (e.g., increasing) the thickness of the hub's outer annular flange 121 from $T_1$ to $T_2$ as illustrated in FIG. 12. Since this modification occurs on the interior area of hub 12 (which is shielded from operational airflow by nose cone 16 as illustrated in FIG. 1), increasing the thickness of outer flange 121 in this way will not affect aerodynamic or noise performance.

For rotor assemblies using equally-spaced rotor blades, balance of the rotor assembly is generally not a problem However, as described above, rotor assembly 10 utilizes unequal rotor blade spacing. Accordingly, another goal o he present invention is to balance rotor assembly 10 based on its unequal rotor blade spacing. Conventional methods of rotor balancing involve the drilling of holes to remove material from strategic areas of the rotor assembly. However, it was discovered that this introduced unacceptable levels of stress on the rotor assembly. Accordingly, the present invention strategically adds material to rotor assembly 10 in order to balance same.

Referring again to FIGS. 10 and 11, which illustrate a machined rotor assembly, ring 123 with angular pad portion 124 is integrated with forward side 12A and backside 12B of hub 12. If the rotor assembly is cast, angular pad portions 124 are cast in place, i.e., no ring 123 is constructed. In each case, the balancing modification is kept out of any operational airflow experienced by the rotor assembly. Accordingly, ring 123 and/or angular pad portion 12 will not affect aerodynamic efficiencies.

For the machined rotor assembly, construction of ring 123 and angular portion 124 could be carried out as follows. The entirety of ring 123 would be initially machined to a height L+ΔAL. Ring 123 would then be machined down to a height L everywhere except for angular portion 124 which is specifically located as is well known in the art so that the rotor assembly will be balanced.

For final balancing of either a machined or cast rotor assembly construction, the rotor is rotated at operational speeds and angular pad portion(s) 124 are smoothly ground or milled down as needed. Note that only exterior surfaces of angular pad portion(s) 124 are milled, i.e., no holes are drilled into angular pad portion(s) 124.

Angular pad portion 124 reacts to rotor rotation in a manner similar to that of rotor blades 14. That is angular pad portion 124 experiences radial acceleration and the resulting inertial force that induces a bending moment concentrated at the area or root 124R where an angular pad portion 124 blends into hub 12. Accordingly, as with rotor blades 14, root 124R can be defined by a concave fillet having a radius of curvature that allows angular pad portion 124 to achieve acceptable operational stress levels.

The advantages of the present invention are numerous. The rotor assembly is optimized in terms of cost, weight and strength. A variety of construction features and methods are presented so that any fan rotor assembly can be optimized without compromising the rotor assembly's structural design that has previously been optimized in terms of aerodynamic and/or noise performance.

Although the invention has been described relative to a specific embodiment thereof, there are numerous variations and modifications that will be readily apparent to those skilled in the art in light of the above teachings. For example, other one-piece rotor assembly construction methods and materials can be used without departing from the scope of the present invention. It is therefore to be understood that, within the scope of the appended claims, the invention may be practiced other than as specifically described.

What is claimed as new and desired to be secured by Letters Patent of the United States is:

1. A fan rotor comprising:

a hub having a radial cross-section defined by an I-beam, said hub having a forward side receiving an airflow and a backside opposite said forward side;

a plurality of unequally-spaced rotor blades disposed circumferentially around and extending radially outward from said hub;

each rotor blade from said plurality of rotor blades having a root portion coupled to said hub, said root portion including a concave fillet circumventing said each rotor blade; and at least one of said forward side and said backside of said hub incorporating an axially extending pad for rotational balance.

2. A fan rotor as in claim 1 wherein said hub, each of said plurality of rotor blades with said root portion, and said ring with said pad are made integrally from a cast aluminum alloy.

3. A fan rotor as in claim 2 wherein said cast aluminum alloy is selected from the group consisting of A356-T6, LM-6 and LM-31 aluminum alloys.

4. A fan rotor as in claim 1 wherein said hub, each said plurality of rotor blades with said root portion, and said pad are made integrally from a machined billet of an a aluminum alloy.

5. A fan rotor as in claim 4 wherein said aluminum alloy is a 6061-T6 aluminum alloy.

6. A fan rotor as in claim 1 wherein said concave fillet has a circular radius of curvature.

7. A method of reducing stress on a fan rotor, comprising the steps of:

providing a one-piece rotor having a hub with a radial cross-section defined by an I-beam having an inner annular flange and an outer annular flange coupled to one another by an annular disk, said hub having a forward side receiving an airflow and a backside opposite said forward side, said rotor further having a plurality of unequally-spaced rotor blades disposed circumferentially around and extending radially outward from said hub, each rotor blade from said plurality of rotor blades having a root portion coupled to said hub, said root portion including a concave fillet having a circular radius of curvature circumventing said each rotor blade at least one of said forward side and said backside of said hub incorporating a pad extending axially from said annular disk;

selecting a target stress level;

rotating said rotor;

evaluating stress on said rotor during said step of rotating; and adjusting said radius of curvature and a radial thickness of said outer annular flange based on said step of evaluating to achieve said target stress level.

8. A method according to claim 7 further comprising the step of constructing said rotor integrally from a cast aluminum alloy.

9. A method according to claim 8 further comprising the step of selecting said cast aluminum alloy from the group consisting of A356-T6, LM-6 and LM-31 aluminum alloys.

10. A method according to claim 7 further comprising the step of constructing said rotor integrally from a machined billet of an aluminum alloy.

11. A method according to claim 10 further comprising the step of selecting said aluminum alloy to be a 6061-T6 aluminum alloy.

12. A method of balancing a fan rotor, comprising the steps of:

providing a one-piece rotor having a hub with a radial cross-section defined by an I-beam having an inner annular flange and an outer annular flange coupled to one another by an annular disk, said hub having a forward side receiving an airflow and a backside opposite said forward side, said rotor further having a plurality of unequally-spaced rotor blades disposed circumferentially around and extending radially outward from said hub;

integrating a pad with at least one of said forward side and said backside of said hub, said pad extending axially from said annular disk; and sizing and positioning said pad to rotationally balance said rotor.

13. A method according to claim 12 further comprising the step of constructing said rotor and said pad integrally from a cast aluminum alloy.

14. A method according to claim 13 further comprising the step of selecting said cast aluminum alloy from the group consisting of A356-T6, LM-6 and LM-31 aluminum alloys.

15. A method according to claim 12 further comprising the step of constructing said rotor and said pad integrally from a machined billet of an aluminum alloy.

16. A method according to claim 15 further comprising the step of selecting said aluminum alloy to be a 6061-T6 aluminum alloy.

17. A method according to claim 12 further comprising the steps of:

spinning said rotor;

evaluating balance of said rotor during said step of spinning; and modifying said pad based on said step of evaluating until said rotor is balanced.

18. A method according to claim 17 wherein said step of modifying comprises the step of milling only exterior surfaces of said pad.

* * * * *